United States Patent [19]

Vandewijer et al.

[11] 4,009,046

[45] Feb. 22, 1977

[54] PROCESS FOR TREATING SUGAR-FACTORY MOLASSES

[75] Inventors: Romain Gustave Edgard Vandewijer; Joseph Theo Degeest, both of Kumtisch, Vissenaken, Belgium

[73] Assignee: Raffinerie Tirlemontoise, Brussels, Belgium

[22] Filed: Nov. 8, 1974

[21] Appl. No.: 522,175

[30] Foreign Application Priority Data

Nov. 8, 1973 Belgium ..... 807063

[52] U.S. Cl. ..... 127/47; 210/51

[51] Int. Cl.[2] ..... C13J 1/04

[58] Field of Search ..... 127/47; 210/51; 260/234 R

[56] References Cited

UNITED STATES PATENTS 3,844,835 11/1972 Duchateau et al. ..... 127/47

OTHER PUBLICATIONS

*Sugar Industry Abstracts*, I, vol. 17, Abs. 436 (1955).
*Sugar Industry Abstracts*, II, vol. 27, Abs. 569 (1955).

*Primary Examiner*—R.E. Serwin
*Assistant Examiner*—Sidney Marantz
*Attorney, Agent, or Firm*—Sughrue, Rothwell, Mion, Zinn & Macpeak

[57] ABSTRACT

Process for treating sugar-factory molasses comprising dilution of the molasses with cold water, precipitation of the saccharose in the diluted molasses by addition of quicklime, and then filtration of the so-treated molasses, wherein an electrolyte selected from the group consisting neutral salts and acid salts is added to the molasses at the latest during the cold precipitation.

6 Claims, 3 Drawing Figures

PROCESS FOR TREATING SUGAR-FACTORY MOLASSES

BACKGROUND OF THE INVENTION

1. Field of the Invention

This invention relates to a process for treating sugar-factory molasses comprising dilution of molasses with cold water, precipitation by addition of quicklime of the saccharose of the thus diluted molasses, and then filtration of the so-treated molasses. This process is well-known as the cold precipitation step of the Steffin process.

2. Description of the Prior Art

It is generally known that in order to cold precipitate by means of quicklime the saccharose of sugar-factory molasses, such molasses has to first be diluted by addition of cold water to a polarization of 6.

Polarization is the value which is commonly used in a sugar-factory in order to characterize the sugar content of a sugar liquor. As a matter of fact, the polarization represents the saccharose concentration, in gr. % $cm^3$, calculated from the measurement made with a polarimeter by supporting that the liquor only contains saccharose as the optically active substance. It is quite certain that technical sugar liquors contain a number of optically active impurities, but, however, their effect is only noticeable at very low saccharose concentrations. It is even possible in this case to reach negative polarizations, which means that substantially no saccharose still remains in the liquor. Within the scope of the present disclosure, the term polarization will be always used in order to characterize the sugar content. It has been remarked that when molasses having a polarization higher than 6 is reacted according to the cold precipitation step of the Steffen process, the results obtained become unsatisfactory.

More particularly, an increase in the sugar content of the filtrate, the so-called cold filtrate, is noted, this filtrate being obtained after filtration of the insoluble saccharose-lime combination formed due to the action of the quicklime, as well as a substituted reduction of the filterability of this combination.

Sugar-factory molasses presents a polarization which generally varies around 68. In order to decrease the molasses polarization to a value allowing use of the cold precipitation treatment, a lower molasses polarization at the beginning of the treatment must be obtained, and a greater amount of cold water has to be added. It is advisable, however, to reduce as much as possible the amount of cold water which is necessary. This is due to the fact that this allows for a reduction in the frigorific group power and also allows for a decrease in the cold filtrate volume. That is to say, for a residual saccharose concentration which is admitted in the cold filtrate, the product of the residual saccharose concentration into the volume of cold filtrate decreases ; in other words, the yield of the precipitation process increases.

Furthermore, all of the molasses impurities concentrate in a smaller cold filtrate volume, which makes concentration by evaporation more economical and allows for an improved price to be obtained as animal food.

It has already been proposed to decrease the cold water amount which is necessary for dilution of sugar-factory molasses by recycling a part of the cold filtrate. However the recycled cold filtrate volume/ molasses volume ratio cannot exceed in the known processes a very low limit beyond which the sugar losses increase and the filterability of the insoluble saccharose-lime combination decreases to practically unacceptable values. Also, in various patents of the applicants, such as Belgian Pat. Nos. 775,564 and 791,033 on the one hand, and 735,802 and 752,422 on the other hand, improvements have been proposed to the Steffen process which have as their effect allowing diluted molasses having a polarization higher than 6 to be treated during the precipitation step. According to the first-mentioned group of patents, the treated molasses is decanted before filtration and a part of the decantation product is recirculated to the diluted molasses, before addition of the quicklime thereto. According to the second-mentioned group of patents, a part of the treated but not yet filtered molasses is recirculated to the diluted molasses before addition of the quicklime thereto. These known processes have already produced for a reduction to some extent in the fresh water amount which is used to dilute the molasses while maintaining an optimum ratio between recycled cold filtrate volume/molasses volume before dilution.

SUMMARY OF THE INVENTION

An object of this invention is to improve the filterability of the precipitate and to decrease the sugar losses in the cold precipitation step of the Steffen process for treating sugar-factory molasses. Also an object of this invention is to allow the improvement in the precipitate filterability and the decrease in the sugar losses to be reached when molasses subjected to the precipitation step has a high polarization, i.e. higher than 6.

A further object of this invention is to achieve an improvement in the precipitate filterability and a decrease in sugar losses when the amount of cold filtrate used for diluting molasses to be used is increased. To this end, according to the invention, an electrolyte selected from the group consisting of neutral salts and acid salts is added to the molasses, at the latest during the cold precipitation.

DETAILED DESCRIPTION OF THE INVENTION

According to a preferred embodiment of the invention, the molasses is partly diluted by recycling the cold filtrate, the ratio between recycled filtrate volume to the molasses volume before dilution being higher than 3.

According to an advantageous embodiment of the invention, the electrolyte is a salt selected from the group consisting of $CaCl_2$, NaCl, Na citrate, and $Ca(NO_3)_2$.

Preferably, the lesser expensive salts, such as $CaCl_2$ for example, will be obviously used.

The amount of salts to be added to the reaction medium, according to the invention, will depend on the desired result, on the initial composition of the molasses, which latter molasses can already contain varying amounts of salts, and on the kind of salt.

As a matter of fact, as shown by the diagram of FIG. 1, the addition of a small amount of a neutral or acid salt already has a favorable effect on the cold filtrate polarization, namely on the sugar losses and on the filterability of the insoluble saccharose-lime combination. The diagram of FIG. 1 has been obtained by treating molasses which have been diluted with cold water to a polarization of 6, according to the conventional batchwise Steffen process by using 120 gr of CaO/100 gr of saccharose and by maintaining a constant temperature at 12°–13° C; increasing amounts of $CaCl_2$ were added to the diluted molasses, before adding quicklime so as to precipitate saccharose from these diluted molasses.

The abscissa of FIG. 1 shows the amounts added of $CaCl_2$, in meqv. (milliequivalents) of $CaCl_2$ per 100 gr of sugar in the diluted molasses ; the ordinate y shows the filtration time in minutes ; the ordinate z shows the filtrate polarization. Curve A illustrates the filterability of the insoluble saccharose-lime combination, this filterability being represented by the filtration time which is necessary in order to filter 500 $cm^3$ of treated molasses under a vacuum of 600 mm of Hg on a Buchner funnel a filtering area of 1 $dm^2$ and provided with a Lainyl (Trade Mark) fabric.

Curve B illustrates the cold filtrate polarization. Although the addition of a small amount of a neutral salt already has a favorable effect, however it is shown that at least 50 meqv of salt/100 gr of saccharose in the treated molasses must be used.

The addition of one or more soluble neutral or acid salts to the reaction medium does not affect the purity of the insoluble saccharose-lime combination since the salts remain in the cold filtrate. On the contrary, since they increase the filterability of this insoluble combination, they make the washing of the insoluble combination more efficient and increase the purity of the insoluble combination after washing.

Other details and features of the invention will become apparent from the description, given hereinafter by way of non-limitative example, of several embodiments of the invention, with reference to FIGS. 2 and 3 as follows.

Figure 1:
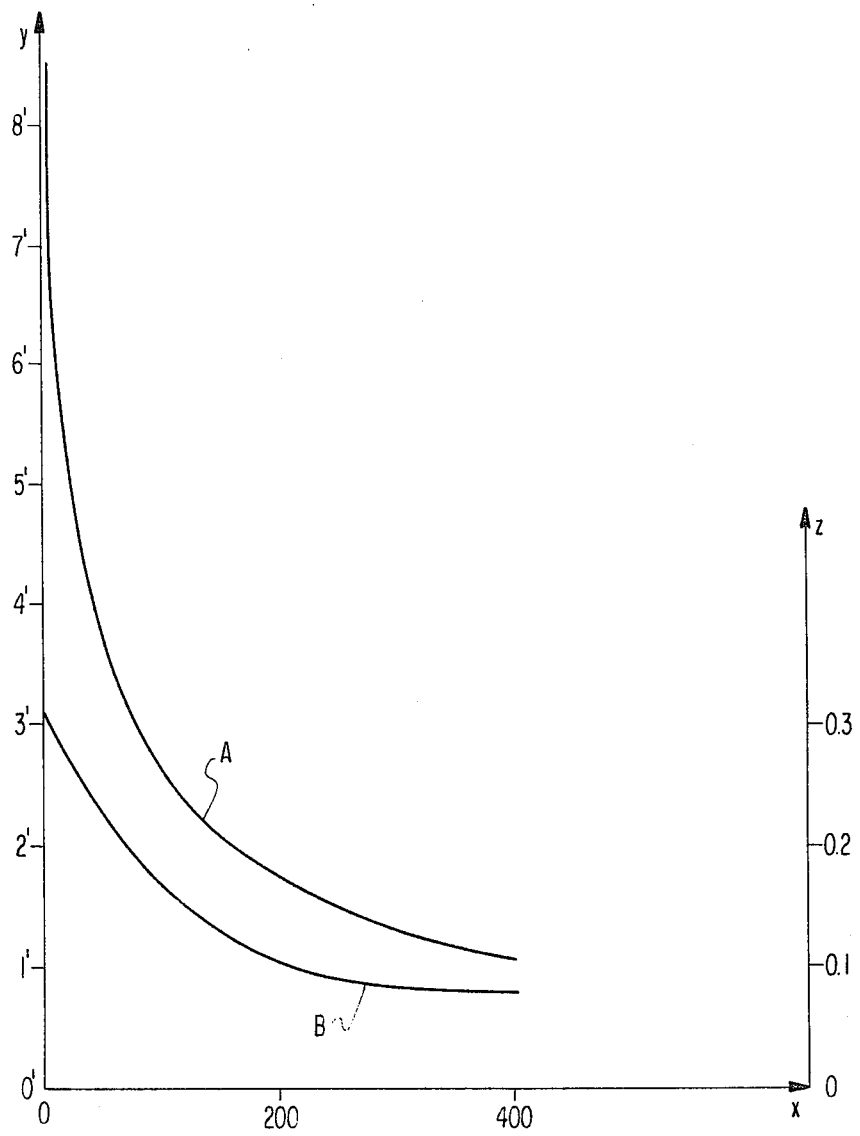
Figure 2:
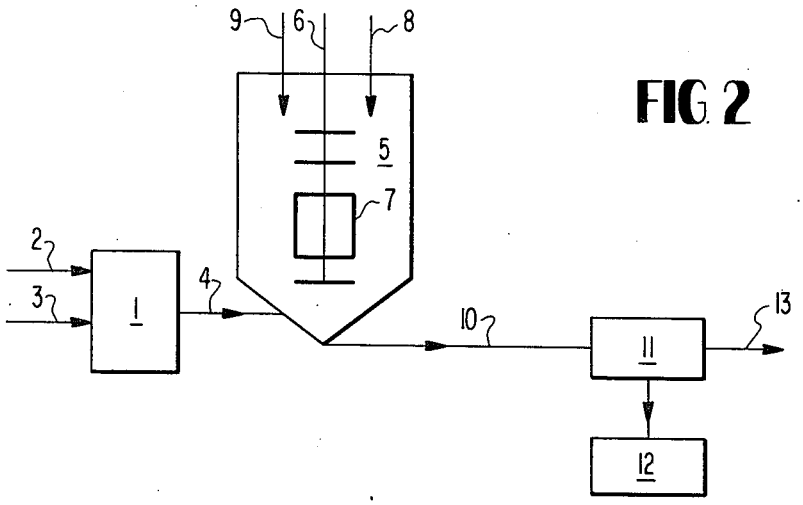
FIG. 2 shows a system for carrying out the process according to the invention in a batchwise manner.

The system shown in FIG. 2 is of the conventional batchwise Steffen type. It comprises a tank 1 for diluted molasses to which a pipe 2 for molasses such as is produced by the sugar-factory and a pipe 3 for cold water of dilution are connected. Diluted molasses are sent by pipe 4 to a reaction vat 5 provided with a mixer 6 and a refrigeration element 7. A feed line 8 for quicklime and, according to the invention, a feed line 9 for an electrolyte selected from the group consisting of neutral salts and acid salts discharge into vat 5. This reaction vat 5 also comprises an outlet duct 10 for the treated molasses, this duct 10 bring the treated molasses onto a filter 11. The insoluble saccharose-lime combination is sent to the sugar manufacture by pipe 13, while the cold filtrate is sent to a concentration plant 12. The so-described plant operates as follows.

Molasses diluted in tank 1 is sent into the reaction vat 5. The salt(s) is then added, and then the quick-lime powder. When the reaction is complete, the reaction vat 5 is emptied and the treated molasses is filtered.

The system described has allowed the results given in following table 1 to be obtained, by working with more and more concentrated dilutions of molasses and by always adding 120 gr of CaO per 100 gr of saccharose used. The temperature was maintained at 13°–14° C during all the tests. Tests 1,2,3 and 4 were carried out without electrolyte addition, by way of comparison. For tests 1', 2', 3', 4', calcium nitrate ($Ca(NO_3)_2$) was added as the electrolyte.

Table 1

Batchwise precipitation Temp : 13 – 14° C CaO added/sugar saccharose : 120%

| Test | Polarization of molasses before dilution | Polarization of diluted molasses | Volume of molasses before dilution, % | Volume of cold water of dilution, % | $Ca(NO_3)_2$ meqv. % sugar (meqv.) | Cold fitrate Polarization | Cold fitrate Dry materials g% $c^3$ | Filtration time |
|---|---|---|---|---|---|---|---|---|
| 1 | | 6 | 8.77 | 91.23 | 0 | 0.23 | 5.34 | 39 sec. |
| 1' | | 6 | 8.77 | 91.23 | 190 | 0.16 | 5.87 | 28 sec. |
| 2 | 68.4 | 8 | 11.7 | 88.3 | 0 | 0.21 | 6.43 | 2 min. 08 sec. |
| 2' | | 8 | 11.7 | 88.3 | 190 | 0.05 | 6.96 | 48 sec. |
| 3 | | 10 | 14.6 | 85.4 | 0 | 0.31 | 7.62 | 9 min. 00 sec. |
| 3' | | 10 | 14.6 | 85.4 | 190 | 0.08 | 7.99 | 1 min. 41 sec. |
| 4 | | 12 | 17.54 | 82.46 | 0 | Bad result no precipitation | | |
| 4' | | 12 | 17.54 | 82.46 | 190 | 0.52 | 9.35 | 4 min. 44 sec. |

It can be clearly seen that addition of the electrolyte has a very favorable influence on the precipitation reaction of the insoluble saccharose-lime combination, for each of the polarization of diluted molasses which are tested. Furthermore, by means of the invention, the polarization limit of diluted molasses from which less favorable results are obtained is substantially raised.

The hereinbefore described system for batchwise treatment can be completed, without departing from the scope of the invention, with a recirculation pipe for the cold filtrate; e.g., with the cold filtrate being recirculated by being sent either into reaction vat 5 or into tank 1 for the diluted molasses.

Figure 3:
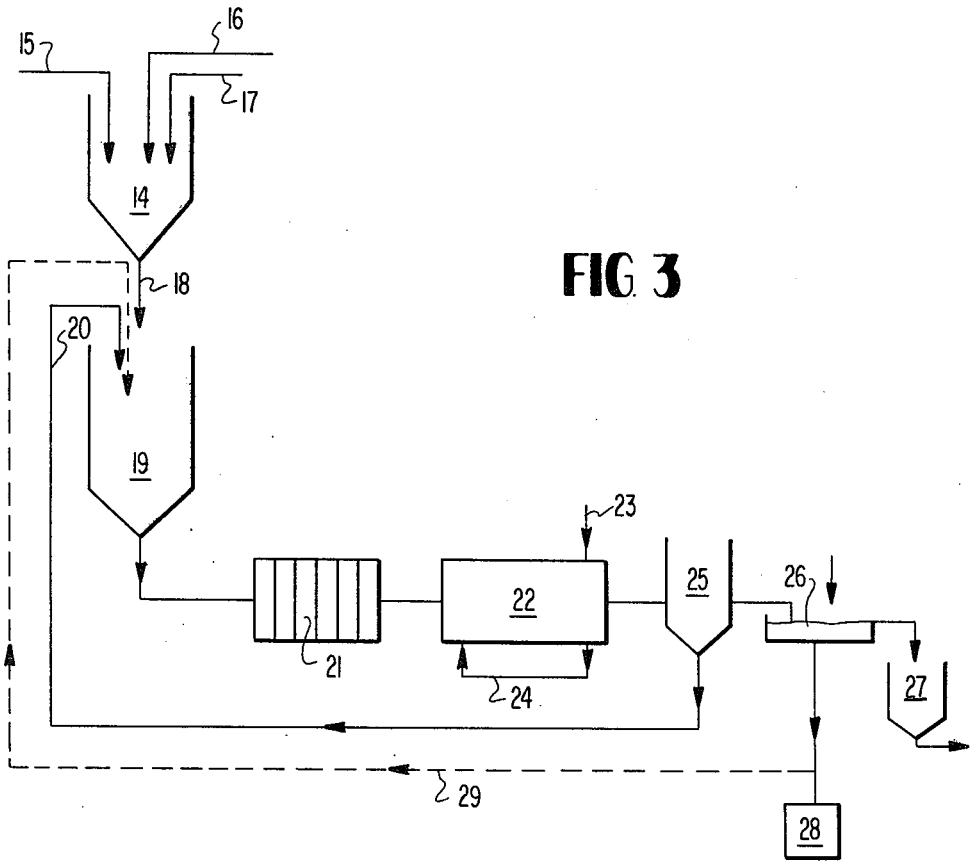
FIG. 3 shows a system for carrying out the process according to the invention in a continuous manner.

The plant shown by FIG. 3 is of the continuous Steffen type, which is improved according to the process described in Belgian Pat. Nos. 775,564 and 791,038, on the one hand, and 735,802 and 752,422, on the other hand.

The plant shown by FIG. 3 comprises a tank 14 for diluted molasses, to which are connected a feed pipe 15 for molasses to be treated, i.e., molasses which has not yet been diluted, and according to this invention a feed pipe 17 for a saline solution selected from the group consisting of neutral salts and acid salts. The diluted molasses is sent by pipe 18 into a mixing vat 19 where a pipe 20, such as is hereinafter described, opens. At the outlet of the vat 19, the mixture is cooled by means of a heat exchanger 21 and passes into a reaction vat 22 provided with a feed line 23 for the quicklime and a recirculation pipe 24 for treated molasses. The treated molasses leaving the reaction vat 22 is sent into a decanter 25. The treated molasses overflows from the decanter onto a filter 26. Washing water is brought to filter 26 so as to expel the cold filtrate. The insoluble saccharose-lime combination, which is impregnated with washing water, is collected in a storage vat 27 from which it is sent to a process for sugar manufacture. The cold filtrate is sent to an evaporation apparatus 28. From the decanter 25, a pipe 20 recirculates the decantation product mostly comprising unreacted slightly reactive lime into mixing vat 19.

Preferably, a part of the cold filtrate is recirculated by a pipe 29 which, in the embodiment shown, ends in mixing vat 19.

Table 2 gives the test results obtained with the plant shown in FIG. 3.

Tests were carried out without recirculation of cold water and without electrolyte addition (tests 1 to 5), with recirculation of the cold filtrate but without electrolyte addition (tests 6 to 9) and finally with recirculation of the cold filtrate and with electrolyte addition (tests 10 to 13) successively, in order to clearly illustrate the improvement with respect to conventional processes, by means of the electrolyte addition according to the invention.

In all of the tests, the same hourly flow rate of saccharose was passed through the reactor. The amount of CaO used was maintained constant at 120 gr of CaO per 100 gr of saccharose. The temperature in the reaction vat was always 13°–14° C.

cold water added for test 4), a substantial improvement is already obtained in the results. It may be deduced from the series of tests 6 to 9 that a polarization of 12 of the diluted molasses should not be exceeded in order that the incorporation of the quicklime powder is made easier. However, it is found when examining the series of tests 6 to 9 that for a ratio between the cold filtrate volume and molasses volume before dilution, which is higher than 3, the results are lowered when according to the process of the invention, an electrolyte selected from the group consisting of neutral salts and acid salts is also added, $CaCl_2$ in the case of the tests, this ratio between the recycled cold filtrate and the molasses volume before dilution can be raised to above 3 and even to more than 4, while maintaining an extremely low polarization in the cold filtrate which is extracted from the system and a good filterability of the insoluble saccharose-lime combination. The process according to the invention consequently allows to the amount of fresh water fed to the system to be reduced to about 0.36 volume per volume of treated molasses. The volume of the cold filtrate which is extracted from the system also decreases, which corresponds to an increase of the dry material content thereof, which Table 2

| Test Number | Hourly flow rates, liters/hr. Molasses before dilution | Cold water | Recycled cold filtrate | Ratio between recycled cold filtrate volume and molasses volume before dilution | $CaCl_2$ added (meqv.%gr. of saccharose in molasses). | Polarization of molasses diluted with cold water |
|---|---|---|---|---|---|---|
| 1 | 3.158 | 14.84 | — | — | — | 12 |
| 2 | 3.158 | 14.84 | — | — | — | 12 |
| 3 | 3.158 | 11.37 | — | — | — | 14.9 |
| 4 | 3.158 | 8.84 | — | — | — | 18.0 |
| 5 | 3.158 | 8.21 | — | — | — | 19.0 |
| 6 | 3.158 | 8.84 | 6.0 | 1.9 | — | 18.0 |
| 7 | 3.158 | 5.84 | 9.0 | 2.85 | — | 24.0 |
| 8 | 3.158 | 4.56 | 10.29 | 3.258 | — | 28.0 |
| 9 | 3.158 | 4.04 | 10.80 | 3.42 | — | 30.0 |
| 10 | 3.158 | 4.04 | 10.80 | 3.42 | 90 | 30.0 |
| 11 | 3.158 | 1.78 | 13.06 | 4.136 | 90 | 43.7 |
| 12 | 3.158 | 1.83 | 13.01 | 4.123 | 127 | 43.3 |
| 13 | 3.158 | 1.13 | 13.78 | 4.364 | 127 | 51.2 |

| Test Number | Polarization of diluted molasses at the entry to the reaction vat 19 | Dry material content of diluted molasses at the entry to reaction vat 19 in gr%cm³ | Polarization of cold filtrate | Dry material content of cold filtrate (gr%cm³) | Filtrability of the insoluble saccharose-lime combination |
|---|---|---|---|---|---|
| 1 | 12 | 20 | 0.26 | 9.3 | 14 sec. |
| 2 | 12 | 20 | 0.35 | 9.5 | 16 sec. |
| 3 | 14.9 | 24.8 | 0.28 | 11.4 | 17 sec. |
| 4 | 18 | 30.0 | 0.51 | 13.6 | 1 min. 20 sec. |
| 5 | 19 | 31.7 | very bad results | | |
| 6 | 12 | 24.4 | 0.16 | 12.6 | 19 sec. |
| 7 | 12 | 27.9 | 0.21 | 15.0 | 31 sec. |
| 8 | 12 | 30.2 | 0.05 | 16.8 | 45 sec. |
| 9 | 12 | 31.0 | very bad filterability | | |
| 10 | 12 | 32.3 | −0.21 | 17.9 | 28 sec. |
| 11 | 12 | 37.9 | −0.52 | 22.0 | 50 sec. |
| 12 | 12 | 37.2 | −0.31 | 20.9 | 33 sec. |
| 13 | 12 | 39.7 | −0.42 | 22.6 | 50 sec. |

For the first series of tests (1 to 5), it has been found that for a polarization of diluted molasses equal to 8, the results become very bad ; as a matter of fact, when the polarization of the diluted molasses exceeds 15, the amount of solid phase which is precipitated in the reaction vat becomes very high with respect to the amount of liquid phase so that the quicklime powder can be incorporated in the reaction mixture only with difficulty. When, as in the second series of tests (6 to 9), the cold filtrate is recycled so as to decrease the molasses polarization to 12 (it will be found that the amount of cold water added for test 6 is equal to the amount of reaches in the tests made, 22.6 gr%/cm³ ; this makes very economical the concentration by evaporation of this cold filtrate which is extracted from the system.

Furthermore, $CaCl_2$ used as salt has a favorable effect on the food value of the concentrated filtrate for cattle. This feed value is controlled by the ash content which cannot be too high and which must correspond to a sufficiently alkaline-earth element/alkaline element ratio. During the concentration of the cold filtrate, the solubility limit of the KCl salt is reached and consequently this salt begins to precipitate. Under conventional conditions, this KCl-removing operation by crystallization is limited due to the loss of $Cl^-$ions ; addition of $CaCl_2$ increases the $Cl^{116}$ and $Ca^{++}$ ion content of the filtrate, which allows, on the one hand, a further KCl-removing operation and on the other hand an increase in the alkaline-earth element/alkaline element ratio.

Both embodiments of the process according to the invention, hereinbefore described with reference to FIGS. 2 and 3, clearly show to what end the process according to the invention can be worked. In particular, the second example clearly shows the advantage in applying the process according to the invention jointly with a recycling of the cold filtrate if the desired purpose is to decrease to the maximum the amount of fresh water which is fed to the system. The recycling of cold filtrate in the process according to the invention results in additional advantage of also a salt recycling.

It is to be understood that the invention is not limited to the embodiments described and that many variations can be made therein without departing from the scope of the present invention.

We claim:

1. In a process for cold treatment of sugar-factory molasses including diluting the molasses with cold water, adding quicklime to the diluted molasses, precipitating a saccharose-lime combination from the molasses and then filtering the molasses, the improvement which comprises adding an electrolyte selected from the group consisting of $CaCl_2$, $Ca(NO_3)_2$, NaCl, $MgCl_2$, and Na citrate in an amount of at least 50 meqv. per 100 g of the saccharose in the molasses prior to or during one of the steps of dilution, addition of quicklime, and precipitation.

2. The process as claimed in claim 1, wherein the molasses is partly diluted by recycling the cold filtrate, obtained on filtering, the ratio between the recycled filtrate volume and the molasses volume before dilution being higher than 3.

3. The process as claimed in claim 1, wherein the electrolyte is added to the sugar-factory molasses before dilution.

4. The process as claimed in claim 1, wherein the electrolyte is added to the diluted molasses after dilution but before addition of the quicklime.

5. The process as claimed in claim 1, wherein the electrolyte is added during precipitation.

6. The process as claimed in claim 1, wherein the electrolyte is added at the same time as the quicklime.

* * * * *